United States Patent [19]

Saltarelli

[11] 4,036,443

[45] July 19, 1977

[54] REFINER HEAD ASSEMBLY AND REFINING DISK THEREFOR

[75] Inventor: Martin O. Saltarelli, Lenox, Mass.

[73] Assignee: Beloit Corporation, Beloit, Wis.

[21] Appl. No.: 634,612

[22] Filed: Nov. 24, 1975

Related U.S. Application Data

[63] Continuation of Ser. No. 511,936, Oct. 3, 1974, abandoned.

[51] Int. Cl.[2] ..... B02C 7/12

[52] U.S. Cl. ..... 241/297; 241/261.2; 241/298

[58] Field of Search ..... 241/261.2, 261.3, 296–298

[56] References Cited

U.S. PATENT DOCUMENTS

| | | | |
|---|---|---|---|
| 1,369,685 | 2/1921 | Maloney | 241/297 X |
| 3,049,307 | 8/1962 | Dalzell, Jr. | 241/297 X |
| 3,289,954 | 12/1966 | Jones | 241/298 |
| 3,326,480 | 6/1967 | Jones | 241/298 |
| 3,438,586 | 4/1969 | Cancilla | 241/297 X |
| 3,459,379 | 8/1969 | Brown | 241/298 X |

*Primary Examiner*—Roy Lake
*Assistant Examiner*—Howard N. Goldberg
*Attorney, Agent, or Firm*—Dirk J. Veneman; Michael L. Gill; Gerald A. Mathews

[57] ABSTRACT

A refiner head assembly of the type suitable for use in disk refiners, such as those employed in paper pulp processing. The assembly includes a backing head and a refining disk. The disk mounts reversibly between a pair of radially spaced, circumferentially extending flanges upstanding from one face of the head using, for example, a beveled tongue and groove arrangement. The disk has both of its opposed side faces equipped with working surfaces adapted for disk refining. Thus, since the disk is reversible, one can use such a disk for twice as long a duty life as a disk with but one side face equipped with a working surface.

8 Claims, 7 Drawing Figures

REFINER HEAD ASSEMBLY AND REFINING DISK THEREFOR

This is a continuation of application, Ser. No. 511,936 filed Oct. 3, 1974, now abandoned.

BACKGROUND OF THE INVENTION

Disk refiners are used in the paper manufacturing industry to prepare the cellulosic fibers of a paper pulp into a desired condition prior to delivery of the pulp to a paper making machine. In operation, a disk refiner is generally considered to exert a species of abrading action upon individual fibers in a pulp mass with the result that the side outermost layers of the individual, cigar-shaped fibers are frayed, thereby increasing the surface area of the fiber greatly. The operation of a disk refiner is also generally considered to cause a rapid and frequent flexure over a brief time period of the individual fibers in a pulp mass with the result that the bond between the various concentric lamellae comprising an individual fiber are broken down or delaminated to a controlled, desired extent. The various actions of a disk refiner are accomplished in normal operation without significantly reducing the length or individual strength of the fibers.

The disk members conventionally heretofore used in a disk refiner have a working surface on one face thereof, and the disk member is secured to a backing head member by bolts or the like which mount through apertures formed transversely through the disk member. The working surface, as those skilled in the art will appreciate, can have a wide variety of configurations or styles, usually involving a plurality of raised, rib-like projections. In operation, these projections, and other portions of a working surface are gradually abraded away, so that it is periodically necessary to shut down a disk refiner and replace the disks used therein.

There is a strong need in the art for disk members which have a longer duty life so as to reduce the costs of operation and maintenance of a disk refiner without adversely affecting the operating performance characteristics of a disk refiner.

BRIEF SUMMARY OF THE INVENTION

The present invention concerns a refiner head assembly for disk refiners of the type suitable for use in the processing of paper pulp and the like. The refiner head assembly employs a backing head means and a refining disk means which is reversibly interconnectable therewith. Thus, the limitations of disk members heretofore known in disk refiners associated with the fact that such prior art disk members have only a single working surface are substantially completely avoided, and one can achieve a duty life for a single refining disk of this invention which is twice as long as heretofore known for refining disks generally.

An aim of the present invention is to provide for a disk refiner an improved refiner head assembly and refining disk means therefor which has a longer duty life.

Another aim is to provide a reversible refining disk, and refiner head assembly suitable for use therewith for use in a disk refiner.

Another aim is to provide an interengaging reversible refining disk means and refiner backing head means which is practical, reliable, rapidly engaged and disengaged, relatively economical to manufacture, use and maintain, and suitable for use with existing disk refiners with a minimum of structural machine alteration.

Another aim is to provide a reversible refining disk means for a disk refining apparatus which can add versatility to the disk refining apparatus which disk means can be fabricated of many different materials (including plastics and metals) and in many different types of working surfaces.

Other and further objects, aims, purposes, etc. will be apparent to those skilled in the art from the present description, including drawings.

DETAILED DESCRIPTION

Figure 1:
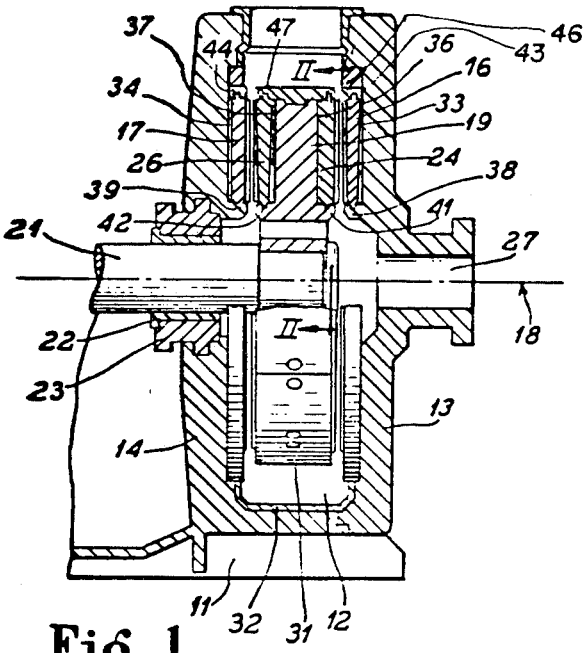
FIG. 1 is a fragmentary view in longitudinal section taken through the region of the rotor assembly in one embodiment of a disk refiner.
Figure 4:
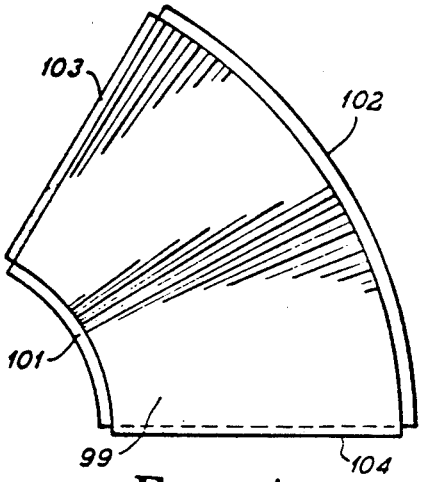
FIG. 4 is a plane view of a single segment employed to comprise a refiner disk used in the embodiment of FIGS. 1-3.
Figure 5:
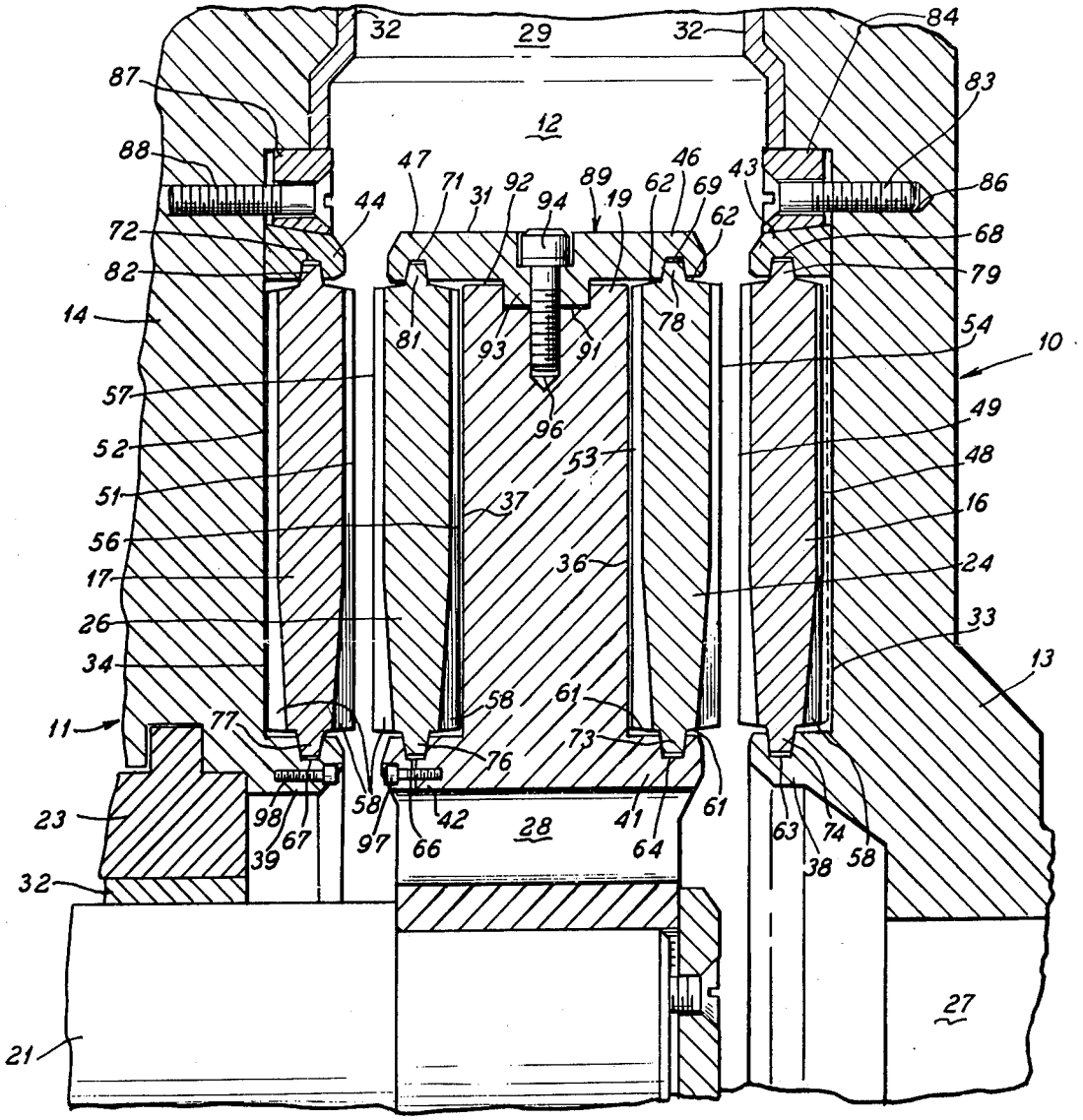
FIG. 5 is an enlarged, fragmentary, detail view of a lower portion of the assembly shown in FIG. 1; but showing two techniques for interconnecting a refiner disk with a backing head.
Figure 6:
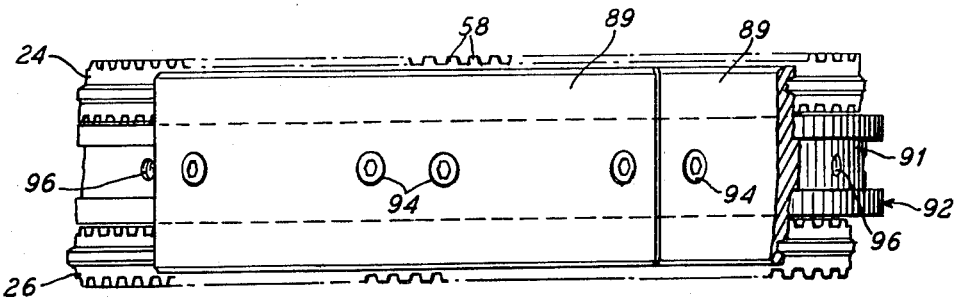
FIG. 6 is an edge view of the rotor assembly of the disk refiner embodiment shown in FIGS. 1, 2, and 5 taken along the line VI—VI of FIG. 2.

Referring to the drawings, there is seen, for example, in FIGS. 1 and 5 an embodiment of a disk refiner, herein designated in its entirety by the numeral 10. Disk refiner 10 includes a housing 11 which is stationary and within which a refining cavity 12 is defined. Inside end walls 13 and 14 of housing 11 defining the longitudinal length of cavity 12 each provide a backing head adapted for the mounting of a stationary so-called sliding refining disk 16 and 17, respectively, the disks 16 and 17 being in spaced, aligned relationship to each other and to axis 18 of refiner 10. Within cavity 12 is a rotating head 19 which is keyed about the end of a floating shaft 21, shaft 21 being supported by a bearing 22 associated with a packing box 23. If desired, in the region of bearing 22, shaft 21 may be equipped with a ceramic sleeve or the like (not shown). Shaft 21 is adapted to be driven by a power head and power transfer means (not shown). Within cavity 12 on opposed surfaces of rotating head 19 in generally aligned relationship to each other are mounted a pair of so-called rotating refining disks 24 and 26. Paper pulp stock is pumped into cavity 12 through axial inlet channel 27 in housing 11 as shaft 21 is driven and head 19 revolves. Refiner 10 is arranged for single-pass operation with the stock being refined in parallel as one half of it passes over one set of disks 16 and 24 while the other half passes over the second set of disks 26 and 17 via a plurality of channels 28 formed through rotating head 19 in the region thereof ajacent shaft 21 and refining disks 24 and 26 (see FIG. 2, for example). After passing across both sets of disks 16 and 24, and 26 and 17, respectively, the two halves of the stock rejoin and leave the refiner 10 through outlet channel 29 in housing 11. Inside walls of cavity 12 are provided with a stainless steel machined cast lining 32.

Alternatively, as those skilled in the art will appreciate, a disk refiner (not shown but similar to refiner 10) can be arranged for refining stock in a two pass operation with, for example, the apertures or channels 28 in rotating head 19 being covered and the outlet channel 29 being capped, and an outlet channel being provided from cavity 12 adjacent shaft 21. In such an operating mode, stock is refined in series as it passes first over one set of disks 16 and 24 followed by a pass over the second set of disks 26 and 17 passing over the outside edge regions 31 of rotating head 19.

In general, the construction and operation of disk refiners is known to the art and does not as such comprise the present invention.

By the present invention, there is provided a refiner head assembly suitable for use in, for example, a disk refiner 10, or the like. Such an assembly utilizes a backing head means which can be either stationary, such as those formed by end walls 13 and 14, or rotating, such as rotating head 19. Thus, in general, a backing head means is adapted for inclusion functionally in a predetermined manner in a given disk refiner. Characteristically, a disk refiner backing head means suitable for the practice of this invention has a generally flattened face with an axis normal thereto. In the case of a stationary backing head, typically there is one such face, as in the case of end walls 13 and 14. In the case of a rotating backing head, typically there are two such faces, as in the case of rotating head 19.

Such a backing head means has relative to its axis (such as axis 18) and its face (such as flattened face 33 of end wall 13 or flattened face 34 of end wall 14, or such as opposed flattened faces 36 and 37 of rotating head 19) an upstanding inner flange and an upstanding outer flange. Thus, end wall 13 is provided with an upstanding inner flange 38 adjacent axis 18, end wall 14 is provided with an upstanding inner flange 39 adjacent axis 18, and rotating head 19 is provided with an inner flange 41 upstanding from face 36 thereof, and an inner flange 42 upstanding from face 37 thereof (inner flanges 41 and 42 being adjacent axis 18). Similarly, end wall 13 is provided an upstanding outer flange 43, and end wall 14 is provided with an upstanding outer flange 44, and, in the case of rotating head 19, an outer flange 46 upstands from face 36 thereof, and an outer flange 47 upstands from face 37 thereof. The term "upstanding" or the like as used herein in reference to flanges indicates only the position of a flange relative to the adjacent face 33, 34 37 or 36.

The outer flange is radially spaced from the inner flange. Thus, flange 43 is radially spaced from flange 38, flange 44 is radially spaced from flange 39, flange 46 is radially spaced from flange 41, and flange 47 is radially spaced from flange 42.

The inner and the outer flanges upstanding from a given face extend circumferentially about the face axis. Thus, inner flanges 38, 41, 42 and 39, and outer flanges 43, 46, 47 and 44, respectively, extend circumferentially about axis 18. Although in the present exemplary embodiments the flanges extend continuously, they need not, as those skilled in the art will appreciate.

By the present invention, a refining disk means, such as disk 16, 17, 24 or 26, has a pair of spaced, opposed side faces, which are preferably parallel to one another. Thus, disk 16 has opposed side faces 48 and 49; disk 17 has opposed side faces 51 and 52; disk 24 has opposed side faces 53 and 54; and disk 26 has opposed side faces 56 and 57 (see FIG. 5, for example). Observe that in FIG. 5, the disks 16, 17, 24 and 26 are shown for illustration purposes as having on each of the respective side faces 48, 49, 51, 52, 53, 54, 56 and 57 thereof rib members designated for each face by the numeral 58 for simplicity which rib members radially extend and provide, with their associated respective facial surfaces, working surfaces for conventional-type disk refining operations. Any convenient or desired arrangement of facial contours may be provided for a given refining disk means used in this invention, as those skilled in the art will appreciate.

Figure 2:
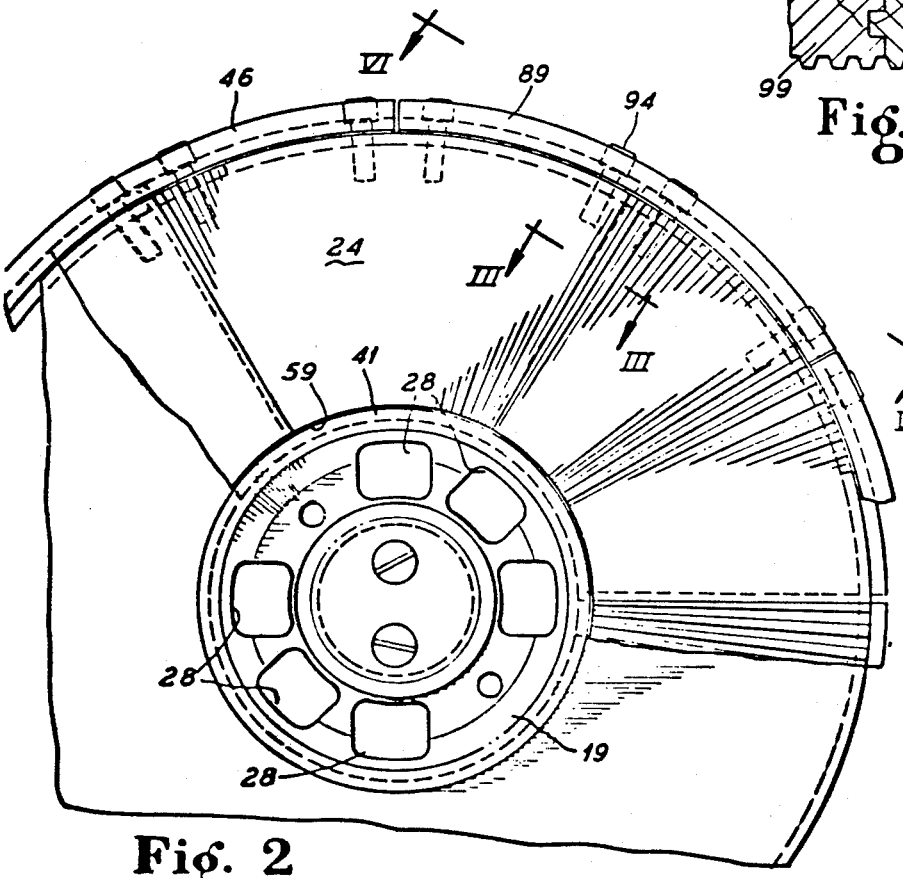
FIG. 2 is an enlarged, fragmentary view in longitudinal section, some parts thereof broken away, taken along the line II—II of FIG. 1.

Each of the disks 16, 17, 24 and 26 has a large central aperture defined therein, such as the aperture 59 of disk 24 (see FIG. 2). Such aperture defines a circumferentially extending inner edge portion, such as the inner edge portion 61 of disk 24 (see FIG. 5). Also, each of the disks 16, 17, 24 and 26 has an outer edge portion circumferentially extending in radially spaced relationship to the inner edge portion thereof, such as the outer edge portion 62 of disk 24 (see FIG. 5).

In the embodiment shown in FIGS. 1, 2 and 5, each of the inner flanges 38, 41, 42 and 39 has a circumferentially extending groove 63, 64, 66 and 67, respectively, formed therein which groove sidewardly opens towards the outside edge of each face 33, 36, 37, and 34 respectively. Similarly, each of the outer flanges 43, 46, 47 and 44 has a circumferentially extending groove 68, 69, 71 and 72, respectively, formed therein which groove sidewardly opens towards the inside edge of each face 33, 36, 37, and 34, respectively.

Also in the embodiment shown in FIGS. 1, 2 and 5, each of the inner edge portions, such as inner edge portion 61 of disk 24, has a circumferentially extending tongue, such as tongue 73 on disk 24, which tongue 73 radially sidewardly projects towards axis 18. Disks 16, 26, and 17 are similarly equipped with corresponding tongues 74, 76 and 77, respectively. Similarly, each of the outer edge portions, such as outer edge portion 62 of disk 24, has a circumferentially extending tongue, such as tongue 78 on disk 24, which tongue 78 radially sidewardly projects away from axis 18. Disks 16, 26 and 17 are similarly equipped with corresponding tongues 79, 81 and 82, respectively.

The respective grooves 63, 64, 66, and 67, and 68, 69, 71, and 72, and the respective tongues 74, 73, 76, and 77, and 79, 78, 81, and 82 have their individual side walls beveled or tapered. The respective inner tongues 74, 73, 76, and 77, and the respective outer tongues 79, 78, 81, and 82, are adapted to seat in the inner grooves 63, 64, 66, and 67, and in the outer grooves 68, 69, 71, and 72, when the respective backing head means and refining disk means are in assembled engagement with one another without any conflicting abutment between a face 33, 34, 36, or 37 and an adjacent (relative thereto) side face of a refining disk 16, 17, 24 or 26, respectively.

The interrelationship between the various component elements is such that each refining disk 16, 17, 24 and 26 is reversible relative to its associated adjacent face 33, 34, 36 and 37, respectively, independently of the orientation of assembled engagement. The various disks 16, 17, 24 and 26 in any given embodiment may be differently sized, but preferably in preferred embodiments the various disks 16, 17, 24 and 26 are of substantially similar dimensions (along with the sizing of the various other component elements).

To interconnect refining disk means with backing head means rigidly but demountably in a desired orientation, any convenient interconnecting means may be employed. Care should be taken, however, to use an interconnecting means which will produce a desired orientation for the exposed side face of each refining disk relative to a backing head means, particularly when the refiner head assembly is operatively mounted in a desired disk refiner. When using a reversible refiner disk of this invention, the side face of a refining disk as such by itself is not a reliable surface to abut against an underlying backing head means because of the wear or abrasion which occurs in or on a side face during use of a refiner disk in a disk refiner, a characteristic which becomes particularly noticable when, after a duty cycle, a refiner disk of this invention is reversed or inverted through 180° and remounting is endeavored. Unless the mounting means is independent of such wear factor, upon such inversion, desired or initial refiner disk exposed side face orientation is lost.

One convenient and preferred interconnecting means comprises a tongue and groove arrangement involving lateral edge portions of refiner disk member and flange members in a refiner head assembly. Another suitable interconnecting means involves bolt means including machine screws and the like with shim means, the bolt means extending through refiner disk means and being threadably received within a backing head means, the shim means being chosen so as to provide a desired spacing between face of backing head means and opposed side face of refiner disk means. Another suitable interconnecting means involves some combination of the tongue and groove and bolt and shim arrangements. Other and further interconnecting means for reversible refiner disks or plates will be apparent to those skilled in the art, but it is preferred to postition the refining disk means between a pair of radially spaced flange means associated with the backing head means.

In FIGS. 1, 2, 5 and 6 is illustrated one embodiment of a tongue and groove interconnecting means. Here, the outer flanges 43, 44, 46 and 47 are separated from their associated respective end walls 13 and 14 and rotating head 19, and each of these flanges is so mounted against, and relative to, its associated respective backing head means (e. g. end wall 13 or 14, or rotating head 19, as the case may be) that a radially exertable, variable force is available for bringing the respective tongues and grooves (as above detailed) into rigid interengagement with a sort of camming action provided by the outer flanges 43, 44, 46 and 47. Thus, for example, screw 83 in an assembly operation is loosened from engagement with end wall 13 thus releasing wedge member 84 from camming engagement of its side walls with end wall 13 on one side and with outer flange 43 on the opposite side. Mating tapered engaging surfaces on wedge 84 and outer flange 43 retain the base of flange 43 in assembled engagement with face 33 of end wall 13. After screw 83 and wedge 84 are removed, refining disk 16 is removed, and replaced or inverted, as desired, and then the refiner head assembly is reassembled. The thickness of wedge 84 is chosen so as to permit wedge 84 to move flange 43 radially against refining disk 16 until tongues 74 and 79 thereof are rigidly engaged with grooves 63 and 68, respectively, as screw 83 is advanced into its threaded bore 86 in end wall 13. A plurality of wedges 84 and of screws 83 are preferably employed. The operation and structure of wedge member 87 and screw 88 is similar as respects end wall 14 and refining disk 17.

In the case of rotating head 19 in the embodiment illustrated flanges 46 and 47 are integral with one another and comprise portions of an end cap 89. A channel 91 in the outer rim portion 92 of rotating head 19 serves to seat and guide end cap 89 relative to rotating head 19 by reason of the shoulder 93 formed on the radially inside face of end cap 89, shoulder 93 being adapted to slidably engage channel 91 when grooves 69 and 71 are duly engaged with tongues 78 and 79, respectively, of refining disks 24 and 26. A plurality of bolts 94, each of which is threadably received within a radical bore 96 in rotating head 19, serve to clamp the various elements together rigidly. A plurality of end caps 89 and bolts 94 are employed circumferentially about outer rim portion 92 of rotating head 19.

It is sometimes convenient to have the inner flanges adjustable for purposes of mounting a refining disk relative to a backing head means. Such adjustability is illustrated, for example, in FIG. 5 where respective inner flanges 42 and 39 of rotating head 19 and end wall 14, respectively, are separate from rotating head 19 and end wall 14 but are held in radially adjustable engagement therewith by means of bolts 97 and 98, respectively.

Figure 3:
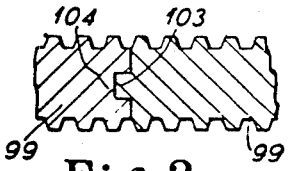
FIG. 3 is an enlarged, fragmentary view in transverse section through a portion of a single refiner disk taken along the line III—III of FIG. 2.

It is preferred, as illustrated in FIGS. 1–5, to employ in each of the refining disks 16, 17, 24 and 26 a plurality of separate segments, such as segment 99 (see FIG. 4), a plurality of which assembled together comprise a single disk. Each such segment 99, in addition to having circumferentially extending flanges 101 and 102 which in an assembled disk comprise the afore described inner and outer tongues of a refining disk, is provided with a radially extending flange 103 and a corresponding radially extending groove 104 at its radial other end, thereby to facilitate engagment of separate segments 99 into a desired refining disk 16, 17, 24 or 26 in an assembled refiner head assembly of this invention and provide a relationship between radially adjoining-segments 99 such as illustrated by FIG. 3. Segments can be formed of molded and or machined plastic (filled or otherwise) or metal, as desired.

Figure 7:
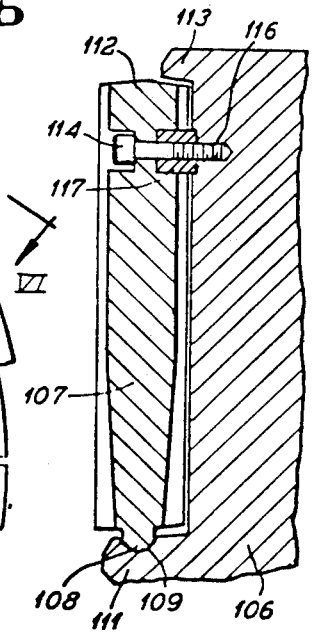
FIG. 7 is a fragmentary view in longitudinal section through an alternative embodiment of a rotor assembly suitable for use in the disk refiner embodiment of FIG. 1.

An alternative manner of interconnecting a backing head means 106 with a refining disk means 107 is illustrated in FIG. 7 where a refining disk means 107 having a radially inwardly projecting, circumferentially extending tongue 108 engages a mating groove 109 formed in inner flange 111 of backing head means 106. A portion of outer circumferential edge 112 of disk means 107 mounts adjacent an outer flange 113 of backing head means 106. Bolts 114 transversely extend through refining disk means 107 adjacent edge 112 thereof into threaded bores 116 formed in backing head means 106. Shimming action for spacing and orienting refining disk means 107 relative to backing head means 106 is provided by sleeves 117 through which bolts 114 extend. Appropriate counter-sink type counter-bores in backing head means 106 and refining disk means 107 are provided for sleeves 117. Observe that such a mounting arrangement is likewise free from orientation problems between backing head means 106 and refining disk means 107 when a refining means is inverted after one face thereof is worn.

Other and further modifications, variations, utilities and the like within the spirit and scope of this invention will occur to those skilled in the art from the present teachings and no undue limitations are to be drawn therefrom.

I claim as my invention:

1. A refiner head assembly for use in a refiner apparatus, said assembly comprising a. a backing head means having an axis, said head means having a circumferentially extending, radially spaced inner flange means upstanding from one face thereof and further having a circumferentially extending, axially spaced outer flange means upstanding from said one face thereof, said flange means being in radially spaced relationship, b. each of said inner and outer flange means further having a circumferentially extending sidewardly opening groove defined therein, said respective grooves being in generally opposed relationship to each other, c. refining disk means adapted to be positioned adjacent said one face between said inner and said outer flange means having an axially located aperture defined therein, said refining disk means having an inner radially inwardly projecting, circumferentially extending tongue means defined in radially inner edge portions of said refining disk means, and further having an outer radially outwardly projecting, circumferentially extending tongue means defined in radially outer edge portions of said refining disk means, d. said inner and outer tongue being adapted to seat in said inner and outer groove means, respectively, when said backing head means and said refining disk means are in assembled engagement with one another, e. said refining disk means defining spaced, opposed side face portions thereon, said face portions adapted for working a pulp composition when said refiner head assembly is operatively connected with a disk refiner apparatus, f. the interrelationship between said backing head means, said refining disk means, said flange means, said groove means, and said tongue means being such that said refining disk is operatively joinable to said backing head with either one of said opposed side faces thereof being in adjacent relationship to said one face and yet maintain a desired configuration between exposed side face and said backing head means.

2. The refiner head assembly of claim 1 wherein said backing head means is adapted to be mounted for rotatable movements about said axis thereof, said backing head means has two of said faces which are generally in spaced, parallel relationship to each other, there is a pair of said refining disk means, there is a pair of said interconnecting means, and one of said refining disk means is joined in such adjacent relationship to a different one of said faces whereby the refiner head assembly is adapted to function as a rotating head in such a given one of disk refiner apparatus.

3. The refining disk means of claim 1 wherein said refining disk means is comprised of a plurality of segments which radially adjoin one another.

4. A refiner head assembly for use in a disk refiner apparatus, said refiner head assembly comprising:

a backing head means, said backing head means having a generally flattened face with an axis normal thereto, and further having, relative to said axis and said face, upstanding inner and outer flange means, said inner flange means being adjacent said axis, said outer flange means being radially spaced therefrom, both of said flange means extending circumferentially and one of said flange means being demountably secured to said backing head means;

refining disk means having a pair of spaced, opposed side faces, an apertured center portion defining a circumferentially extending inner edge portion, and an outer edge portion circumferentially extending in radially spaced relationship to said inner edge portion, each of said side faces having defined therein a desired working surface adapted for disk refining usage;

the interrelationship between said backing head means and said refining disk means being such that said refining disk means is adapted to be positioned relative to said backing head means so that either one of said side faces is adjacent said flattened face and said inner and said outer edge portion are adjacent said inner and said outer flange means, respectively; and, interconnecting means demountably joining said inner and said outer edge portions to said inner and said outer flange means, respectively, and adapted to maintain a desired orientation between exposed side face and said backing head means;

said refiner head assembly being characterized by said inner edge portion and said outer edge portion each being provided with a radially projecting, circumferentially extending tongue portion with beveled side wals, and said inner flange means and said outer flange means each having defined therein a radially extending circumferentially extending groove portion with beveled side walls, said tongue portions being rigidly engageable with said groove portions when the demountable flange means is secured to said backing head means, thereby providing said interconnecting means.

5. The refiner head assembly of claim 4 wherein said outer flange means is demountably secured to said backing head means.

6. The refining disk means of claim 5 wherein said refining disk means is comprised of a plurality of segments which radially adjoin one another.

7. The refiner head assembly of claim 4 wherein said inner flange means and said outer flange means are each demountably secured to said backing head means.

8. The refining disk means of claim 4 wherein said refining disk means is comprised of a plurality of segments which radially adjoin one another.

* * * * *